US005630890A

United States Patent [19]

Smashey et al.

[11] Patent Number: 5,630,890

[45] Date of Patent: May 20, 1997

[54] MANUFACTURE OF FATIGUE-RESISTANT HOLLOW ARTICLES

[75] Inventors: Russell W. Smashey, Loveland, Ohio; Andrew P. Woodfield, Cold Spring, Ky.; Michael F. X. Gigliotti, Jr., Scotia, N.Y.; Kenneth J. Meltsner, Johnstown, Pa.

[73] Assignee: General Electric Company, Cincinnati, Ohio

[21] Appl. No.: 380,533

[22] Filed: Jan. 30, 1995

[51] Int. Cl.[6] ..... C22F 1/18

[52] U.S. Cl. ..... 148/669; 148/527; 228/262.71

[58] Field of Search ..... 148/527, 669; 228/262.71

[56] References Cited

U.S. PATENT DOCUMENTS

| | | | |
|---|---|---|---|
| 4,820,360 | 4/1989 | Eylon | 148/669 |
| 4,832,760 | 5/1989 | Eylon et al. | 148/20.3 |
| 4,851,053 | 7/1989 | Froes et al. | 148/11.5 |
| 4,851,055 | 7/1989 | Eylon et al. | 148/20.3 |
| 4,982,893 | 1/1991 | Ruckle et al. | 228/220 |
| 5,108,517 | 4/1992 | Kimura et al. | 148/527 |
| 5,226,982 | 7/1993 | Eylon | 148/522 |
| 5,429,877 | 7/1995 | Eylon | 228/262.71 |

OTHER PUBLICATIONS

"Surface Hardening of Ti–6A1–4V Alloy by Hydrogenation" by Wu and Wu, *Scripta Met*, vol. 25, pp. 2335–2338 (1991).

Abstract of "Superplastic Forging of Ti Powder Preforms" by Kimura, et al., *J. Japanese Society of Powder Metallurgy*, vol. 38 (1991) pp. 650–655 (abstract only).

*Primary Examiner*—John Sheehan

*Attorney, Agent, or Firm*—Andrew C. Hess; David L. Narciso

[57] ABSTRACT

A hollow article is made by providing and diffusion bonding the opposing parts of an article made of an alpha-beta titanium alloy. Hydrogen is introduced into the surface of an internal cavity before, during, or after diffusion bonding. The article is heat treated with the hydrogen present, typically by solution treating and aging the hydrogen-containing bonded article. The result is the production of a microstructure at the internal surface of the cavity that is resistant to fatigue-crack initiation, while retaining a microstructure throughout the rest of the article that is resistant to fatigue-crack propagation. After heat treating, the hydrogen is removed from the article, and any further heat treating and other operations are completed.

19 Claims, 3 Drawing Sheets

MANUFACTURE OF FATIGUE-RESISTANT HOLLOW ARTICLES

BACKGROUND OF THE INVENTION

This invention relates to the manufacture of fatigue-resistant articles that intentionally have internal cavities present, and, more particularly, to the manufacture of hollow fan blades for aircraft gas turbine engines.

In a conventional aircraft gas turbine (jet) engine, air is drawn into the front of the engine and compressed by an axial flow compressor. The compressed air is mixed with fuel, and the mixture is ignited to produce a hot exhaust gas. The exhaust gas flows through a turbine that drives the axial flow compressor, and the exhaust gases are then exhausted through the rear of the engine to drive the engine and aircraft forward. Additional thrust may be generated by using the exhaust gases to turn a large-diameter fan that draws additional air, sometimes termed bypass air, through a ducted fan that surrounds the engine core.

The fan employs a large number of fan blades that extend outwardly from a central shaft. These fan blades act much like propeller blades to drive the bypass air flow rearwardly, generating thrust through the reaction between the fan blades and the bypass air flow. In a large aircraft engine such as those used in airliner jumbo jets, the fan blades may be several feet long.

The fan blades must be strong and also quite light, because they turn rapidly on the central shaft and generate a great deal of centrifugal loading on the central shaft. The heavier the fan blades, the heavier must be the shaft, bearings, support structure, etc. Additionally, the fan blades must be resistant to various types of damage that can occur during their use. The fan blades must resist erosion of particles in the air, damage from impacts such as ingested particles and birds, and accumulations of fatigue damage.

One approach to the design of fan blades is to manufacture the fan blades from a relatively light weight alloy such as a titanium alloy. Weight can be saved by making the fan blade hollow, with reinforcing ribs extending internally between the sides of the surface skins of the fan blade. Techniques are known for manufacturing such hollow fan blades of titanium alloys, with well defined internal cavities intentionally present to reduce the weight of the fan blade.

An important consideration which limits the life of hollow fan blades is fatigue. During engine operation, the fan blade is loaded in a generally axial direction by centrifugal force. There is additionally a variable loading superimposed on the constant component of the loading as the fan blade rotates past struts and other structure in the fan duct. The combined constant and variable components of the loading produce fatigue cracks in the fan blade. If any one fatigue crack in a fan blade propagates to a sufficiently large length, it causes the fan blade to fail.

The development of fatigue cracks generally occurs by a two-stage mechanism involving first initiation of the fatigue crack at a surface and then growth of the fatigue crack through the body of the fan blade. Various techniques are used to reduce fatigue crack initiation and growth. The techniques which rely upon metallurgical processing usually involve specially selected surface treatments and microstructures to limit fatigue crack initiation, and other specially selected interior microstructures to limit fatigue crack growth. The microstructures that minimize fatigue crack initiation are typically different from those that minimize fatigue crack growth.

Applying these principles to fatigue crack control in fan blades, the fan blade will usually be produced to have a particular microstructure throughout its body that is resistant to fatigue crack growth. There are a number of processes that can be subsequently applied to the external surfaces of the fan blades to alter their structure to be more resistant to fatigue crack initiation. However, where the fan blade is hollow, the interior of the fan blade is inaccessible to preferential surface heaters and mechanical peeners that are often used on the external surfaces. Since they are not treated to minimize fatigue crack initiation, these internal surfaces of the cavities become preferential sites for fatigue crack initiation during service, leading to early failure of the fan blade.

There is a need for an improved approach to the manufacture of hollow fan blades and other types of articles that are subjected to fatigue during service. Such an improved approach must be compatible with the other manufacturing steps of the hollow article, and also not adversely affect other properties of the hollow article such as strength, corrosion resistance, impact resistance, etc. The present invention provides such an approach, and further provides related advantages.

SUMMARY OF THE INVENTION

The present invention provides a method for manufacturing fan blades and other types of hollow articles, and the fan blades and articles so produced. The hollow articles have the surfaces of their internal cavities (as well as their external surfaces, if desired) treated to produce a microstructure that is resistant to fatigue crack initiation, thereby improving the fatigue life of the articles. The procedure does not adversely affect the other aspects of the structure and properties of the hollow articles.

In accordance with the invention, a method of manufacturing a hollow article comprises the steps of providing an article having an internal cavity and having hydrogen present in the article at a surface of the internal cavity, heat treating the article in a hydrogen-containing atmosphere, and removing the hydrogen from the article.

More specifically, a method of manufacturing a hollow article comprises the steps of preparing at least two opposing parts of a hollow structure. The parts are made of a titanium alloy and, when assembled, define an internal cavity. The opposing parts are processed by diffusion bonding the opposing parts together to form a bonded article and introducing hydrogen from the interior of the internal cavity to the surface of the internal cavity. The step of introducing hydrogen may occur before, simultaneously with, or after the step of diffusion bonding. The method further includes solution treating the bonded article at a solutionizing temperature in a hydrogen-containing solutionizing atmosphere, aging the bonded article at an aging temperature less than the solutionizing temperature in a hydrogen-containing aging atmosphere, and removing the hydrogen from the bonded article so that the hydrogen content at the surface of the internal cavity is less than a preselected amount.

In a most preferred embodiment, a method of manufacturing a hollow fan blade comprises the steps of preparing at least two opposing parts of a hollow fan blade made of an alpha-beta titanium alloy. When assembled, the two parts have an internal cavity therein. The opposing parts are bonded together to form a bonded article. The opposing parts are heated to a temperature of from about 1020° F. to about 1380° F. in an atmosphere comprising a hydrogen-containing gas to introduce hydrogen from the interior of the internal cavity to the surface of the internal cavity. This step of introducing hydrogen may occur before, simultaneously with, or after the step of diffusion bonding. The bonded article is heated to a temperature of from about 1245° F. to about 1420° F. in an atmosphere comprising a hydrogen-containing gas to solution treat the bonded article, and heated to a temperature of from about 930° F. to about 1290° F. in an atmosphere comprising a hydrogen-containing gas to age the bonded article. In each heat treatment in a hydrogen-containing gas, the atmosphere is preferably a mixture of less than about 5 volume percent hydrogen in a carrier gas, to minimize the likelihood of a hydrogen explosion, but greater hydrogen contents are operable. The bonded article is thereafter heated to a temperature of from about 930° F. to about 1290° F. in an atmosphere that is substantially free of hydrogen to remove the hydrogen from the bonded article. Optionally, the bonded article may be post-dehydrogenation treated by any operable approach that does not adversely affect the structure produced by the hydrogenation treatment.

The article produced by the present approach is unique. It has a microstructure resistant to fatigue crack initiation at the surfaces of the internal cavities. It may have a microstructure resistant to fatigue crack initiation at the external skin surfaces of the article, produced by the hydrogenation-dehydrogenation approach of the invention or by other techniques. The interior microstructure of the article is resistant to fatigue crack growth. This combination of structures provides the greatest resistance to fatigue cracking possible with such an article.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
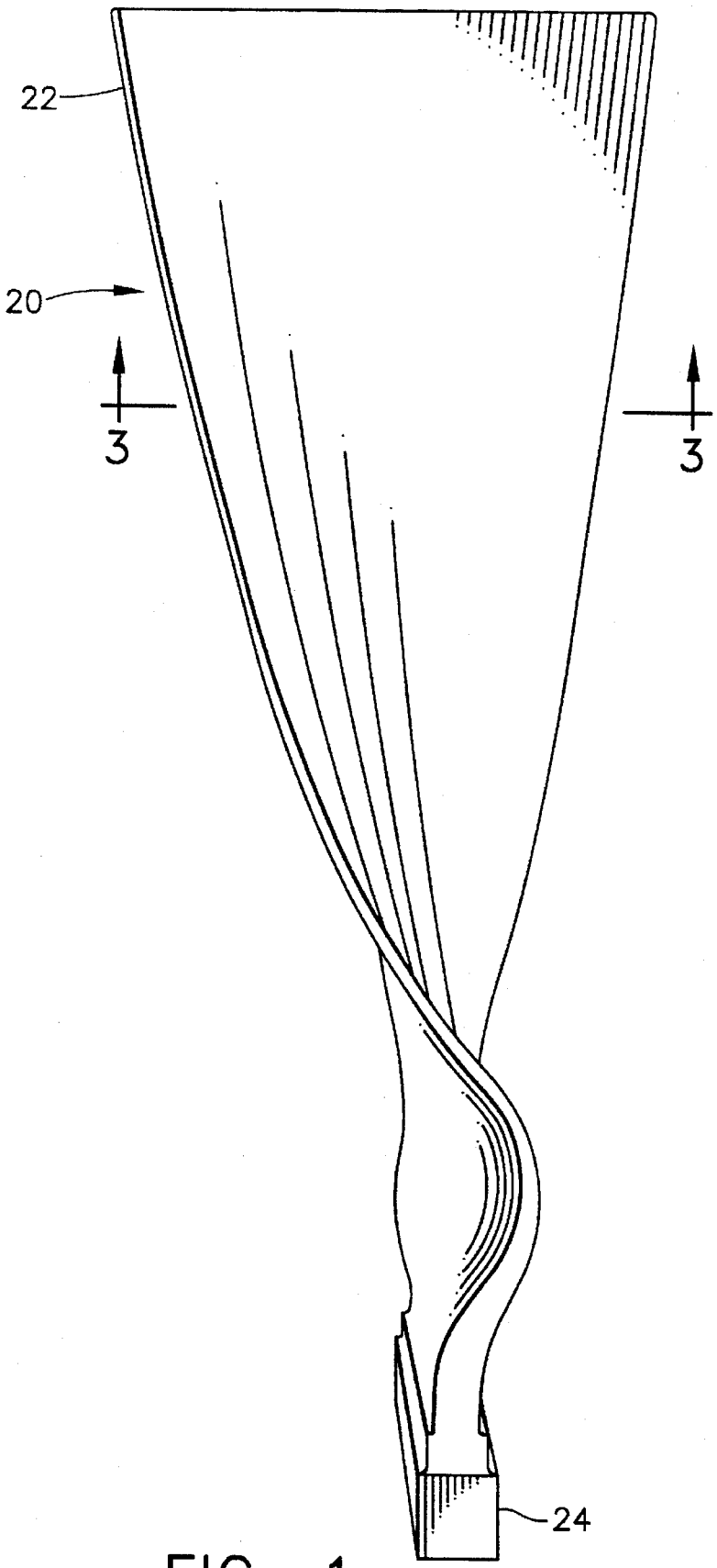
FIG. 1 is a perspective view of a hollow fan blade.

A fan blade 20 manufactured according to the present approach is shown in FIG. 1. The fan blade 20 has a hollow airfoil region 22 and a root section 24 that, in service, is attached to a fan disk (not shown). The fan disk is in turn attached to a drive shaft (not shown) that rotates the fan blade 20 about the axis of the drive shaft.

Figure 2:
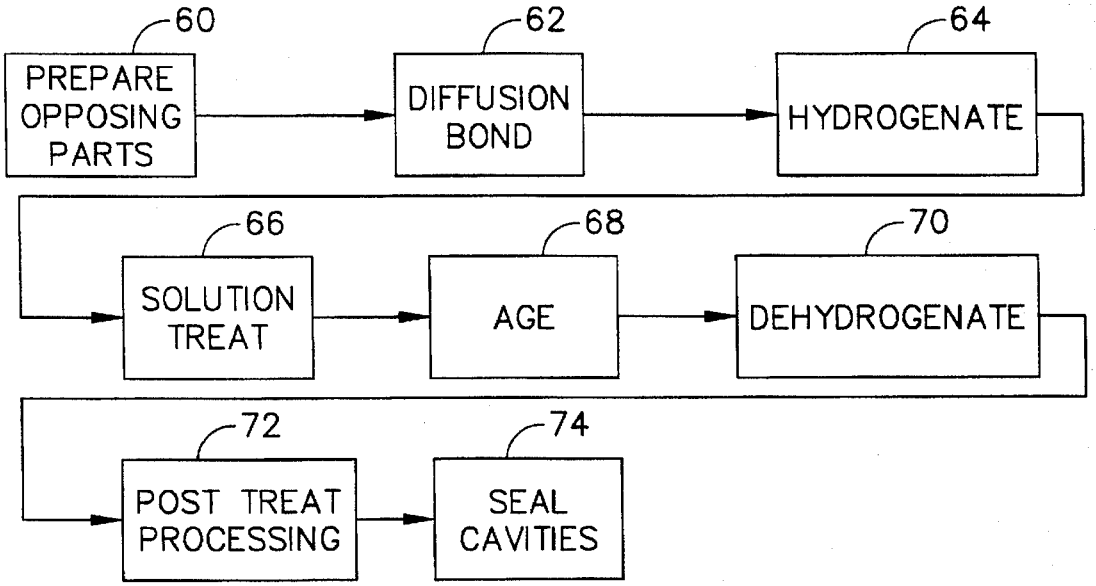
FIG. 2 is a block flow diagram of the method of the invention.

The preferred manufacturing method of the invention is integrated with an established approach for preparing the hollow fan blade 20, and the combined approach is depicted in FIG. 2. At least two opposing parts 26 of the airfoil region 22 are prepared by conventional techniques, numeral 60. The parts are preferably made of a titanium alloy, more preferably an alpha-beta titanium alloy, and most preferably the alloys of nominal composition Ti-6Al-4V or Ti-4Al-2Sn-4Mo-0.5Si, an alloy commercially available from Imperial Metals Industry, PLC and commonly known as IMI550. (All alloy compositions herein are given in weight percent, unless stated to the contrary.)

Figure 3:
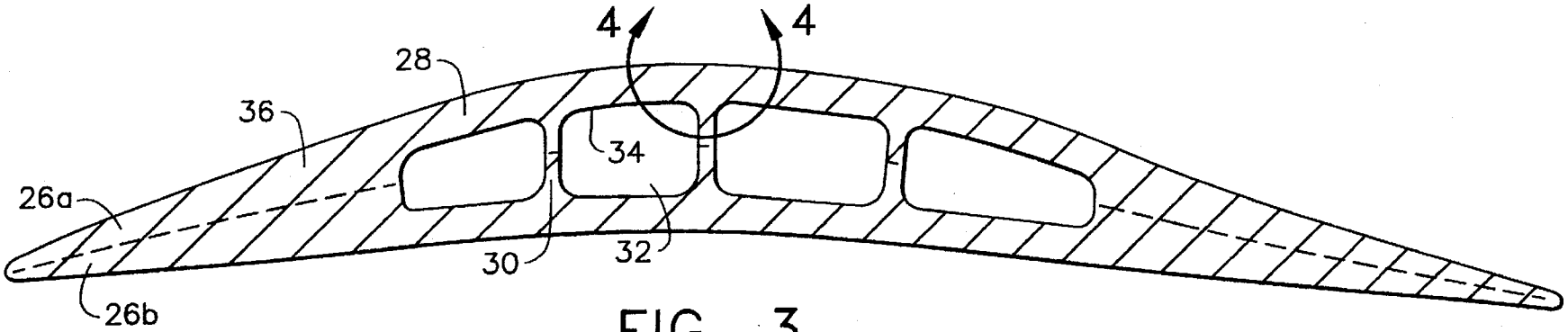
FIG. 3 is an enlarged sectional view, taken on line 3—3, of the hollow fan blade of FIG. 1.

FIG. 3, a sectional view of the airfoil region 22 of FIG. 1, shows the two parts **25*a* and 26*b* that are used to form the airfoil region 22 in the preferred approach, in dashed lines. The two parts 26*a* and 26*b* each include a skin region 28 and ribs 30 that define a number of internal cavities 32. Each of the internal cavities 32 has a surface region 34. The portion of the parts 26 distanced apart from the surface region 34 is the body 36 of the fan blade 20**.

The two or more parts 26 are diffusion bonded together, numeral 62. Diffusion bonding is accomplished by applying an external pressure to the parts 26 so that the interfacing regions bond together, while simultaneously heating the parts to an elevated temperature at which the diffusion bonding can occur. Typical diffusion bonding conditions are in a temperature range of from about 1600° F. to about 1750° F. and a bondline pressure of from about 15 to about 300 pounds per square inch absolute.

Hydrogen is introduced into the interior of the cavities 32 either before the diffusion bonding 62 is commenced, simultaneously with the diffusion bonding, or after the diffusion bonding is completed, numeral 64. If the hydrogen is introduced before diffusion bonding or simultaneously with the diffusion bonding 62, the diffusion bonding operation may be facilitated by lowering the temperature and/or pressure required for the diffusion bonding to be accomplished.

The hydrogen may be introduced in any operable manner. In the preferred approach, a mixture of hydrogen in a carrier gas is contacted to the interior of the cavities 32. A mixture having less than about 5 percent by volume, most preferably about 4 percent by volume, of hydrogen in the inert gas argon, is most preferred. Higher percentages of hydrogen in the atmosphere or pure hydrogen can be used and result in more rapid hydrogenation, but the preferred limit of 5 volume percent hydrogen is selected in commercial operations to minimize the likelihood of a hydrogen explosion. Alternatively, hydrogen may be introduced electrochemically or chemically into the interior of the cavities 32.

It is particularly important in the present invention to contact the interiors of the cavities 32 with hydrogen. It is also acceptable to contact the external surfaces of the skin regions 28 with hydrogen if it is desired to treat them in the manner to be discussed subsequently. Alternatively, the external surfaces of the skin regions 28 may be masked with an hydrogen-impenetrable coating such as an oxide to prevent the hydrogen from contacting the external surfaces.

In the preferred approach, a mixture of 4 volume percent hydrogen in argon is flowed through the interior of the blade. The rate of flow need not be high, and in a practice of the invention the hydrogen/argon mixture was flowed at a rate of 5 cubic feet per hour. During this stage of the manufacturing operation, the interior cavities 32 are open at both ends, and the hydrogen/argon mixture can be flowed through the interior of the fan blade 20 in a continuous flow.

The hydrogen/argon mixture is flowed through the cavities 32 at a temperature and for a period of time sufficient to yield a desired diffusional penetration of hydrogen into the surfaces 34 of the cavities 32. A preferred hydrogenation process is accomplished at a temperature of from about 1020° F. to about 1380° F. Most preferably, the hydrogenation 64 is accomplished at a temperature of 1300° F. for 24 hours. This most preferable hydrogenation process produces an average hydrogen concentration of about 0.45 weight percent within 0.010 inches of the surface 34.

After the hydrogenation of the surfaces 34 of the cavities 32 is completed to a sufficient degree, the fan blade article 20 is heat treated in any operable manner. In a preferred approach, the fan blade is solution treated and aged. A solution treatment 66 is performed by heating the fan blade in a hydrogen-containing atmosphere, preferably the same composition atmosphere as used in the hydrogenation step 64, to a temperature of from about 1245° F. to about 1420° F. for two hours. Equivalent treatments can be used instead of this preferred solutionizing treatment. After solutionizing, the fan blade is cooled by furnace cooling.

An aging treatment 68 is performed by heating the fan blade in a hydrogen-containing atmosphere, preferably the same composition atmosphere as used in the hydrogenation step 64, to a temperature of from about 900° F. to about 1300° F., most preferably 1110° F. At an aging temperature of 1110° F., the aging time is 8 hours. After aging is complete, the fan blade is cooled by furnace cooling to ambient temperature.

The elevated temperature solution treating and aging steps are preferably performed in a hydrogen-containing atmosphere to prevent dehydrogenation of the surface 34 by diffusion of hydrogen out of the surface 34. The fan blade or other article may be maintained in pure argon or other non-oxidizing atmosphere at lower elevated temperatures, and need not be protected at all when at low and ambient temperatures. Heating and cooling are preferably performed in vacuum or inert atmosphere, and the hydrogen flow is commenced when the article reaches the treating temperature.

After the heat treatment is complete, the hydrogen is removed to a preselected low level from the fan blade or other article in a dehydrogenation treatment 70. In the dehydrogenation treatment, the article is heated to a temperature below the solution treatment temperature for a period of time in an atmosphere or vacuum that is substantially free of hydrogen. The hydrogen in the article near the surface diffuses out of the surface into the atmosphere. The dehydrogenation treatment 70 is preferably accomplished at a temperature of from about 1100° F. to about 1400° F. A most preferable dehydrogenation treatment is at a temperature of about 1110° F. for 40 hours in vacuum. This treatment reduces the hydrogen content adjacent to the surface 34 to less than about 120 parts per million (ppm) for the case of the Ti-6Al-4V alloy, a desirable level to prevent subsequent embrittlement of the article.

Figure 5:
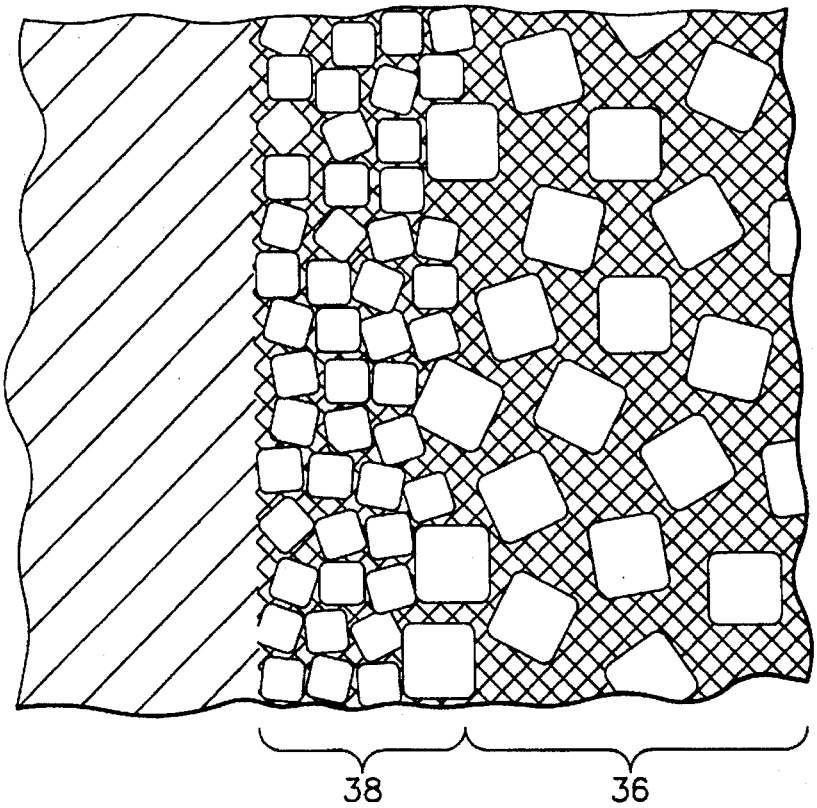
FIG. 5 is a schematic further enlargement of a portion of the surface of the internal cavity within the fan blade of FIG. 4, taken in area 5—5, and showing an exemplary microstructure produced by the processing method of the invention.
Figure 4:
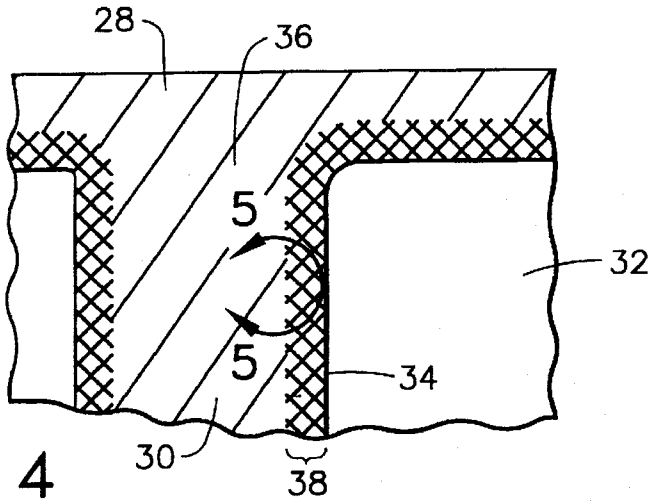
FIG. 4 is a schematic enlargement of a portion of the surface of the internal cavity within the fan blade of FIG. 3, taken in area 4—4.

The present approach is founded upon the observation that the alloy having hydrogen present responds to the heat treatment (66, 68) differently than does the alloy with no hydrogen present. FIGS. 4 and 5 present enlargements of the sectional view of FIG. 3 showing the effects of the heat treatment. As depicted in FIG. 4, the response to heat treatment 66, 68 of a near-surface region 38 into which hydrogen has diffused is different from the response of the body 36 of the fall blade. The depth of the near-surface region 38 can be varied by the extent of the hydrogenation treatment. FIG. 4 illustrates the case where the skin region 28 of the fan blade 20 has not been treated with hydrogen, and therefore does not show the hydrogen-responsive structure. Hydrogen diffusion into the skin region 28 can be blocked by a coating of an oxide or other material of low hydrogen diffusivity.

FIG. 5 depicts the different microstructures of the near-surface region 38 and the body 36 in greater detail. Where the fan blade 20 is made of an alpha-beta titanium alloy such as Ti-6Al-4V or IMI550, the solution heat treat 66 and aging 68 of the hydrogen-containing near-surface region 38 produces a microstructure having a high volume fraction of fine alpha phase on the order of 1–100 micrometers in size in a fine structure, transformed beta matrix. This microstructure is particularly successful at resisting fatigue crack initiation.

In the body region 36, to which hydrogen did not penetrate during the hydrogenation treatment 64, the microstructure is different. This microstructure comprises primarily coarser islands of discontinuous alpha phase having a size of 75 to more then 400 micrometers, in a matrix having a high volume fraction of fine-scale, transformed beta phase. This microstructure is successful in resisting fatigue crack growth.

Inasmuch as fatigue cracks usually initiate at free surfaces such as the surface 34 of the internal cavity 32, and then propagate into the body of the article, this combination of microstructures is desirable for resisting both initiation and growth of fatigue cracks.

The microstructures shown in FIG. 5 are presented as exemplary of those produced by the preferred solution treating and aging heat treatment. Other microstructures that are equally resistant to fatigue crack damage can be produced by variations of this heat treatment and by other heat treatments. The present invention is not dependent upon the production of any particular microstructure. Instead, the significant point is that a microstructure resistant to fatigue crack initiation is produced at the surface of the internal cavity 32, which is inaccessible to mechanical treatments, while a microstructure resistant to fatigue crack propagation is produced elsewhere in the hollow article.

The precise mechanism by which the presence of hydrogen affects the microstructure resulting from heat treatment is not known with certainty, nor does the operability of the present invention depend upon any particular mechanism. While not wishing to be bound by any particular explanation of the effect of hydrogen, it is believed that the hydrogen can produce hydrides of different volume than the matrix and distort the atomic lattice so as to influence the character of the phase transformations during heat treatment. Then, when the material is reheated for dehydrogenation 70, localized recrystallization occurs which results in a low aspect ratio grain structure or break-up of an existing platelet structure.

After the dehydrogenation treatment 70 is complete, any of a variety of post-dehydrogenation treatments can be utilized, numeral 72. Such treatments can be further heat treatments to alter the microstructure produced to that point. As an example, there can be a further solution heat treatment and aging. In the solution heat treatment, the article is heated to 1650° F. for 2 hours in vacuum and then cooled at a rate of about 100° F. per minute until it is below 1350° F. and then cooled to ambient temperature. In the further aging treatment, the article is heated to 930° F. for 24 hours in vacuum. Another type of further treatment is, for example, a mechanical treatment to alter the skin region 28 of the fan blade 20. The exterior of the fan blade can be mechanically peened to reduce stresses and induce a fine structure that is resistant to fatigue crack initiation. This mechanical treatment could not be applied to the inaccessible internal surfaces of the cavities 32. Other further treatments not incompatible with the prior treatment according to the invention may also be applied.

At a point prior to the conclusion of the processing, the cavities are sealed, numeral 74. In the case of the fan blade 20, end caps are attached.

The following examples are presented to illustrate aspects of the invention. They should not be interpreted as limiting the invention in any respect.

EXAMPLE 1

A first test specimen was prepared of IMI550 alloy to determine the nature of the structure produced by the hydrogenation, heat treatment, and dehydrogenation procedures. The specimen was given the following treatment: hydrogenation at 1300° F. for 24 hours in an atmosphere of 4 volume percent hydrogen and 96 volume percent argon flowing at 5 standard cubic feet per hour; solution treatment at 1420° F. for 2 hours in a static atmosphere of 4 volume percent hydrogen and 96 volume percent argon; aging at 1110° F. in an atmosphere of 4 volume percent hydrogen and 96 volume percent argon flowing at 5 standard cubic feet per hour; and dehydrogenation at 1110° F. for 24 hours in vacuum. The microstructure of the hydrogen-affected region was found to be refined alpha grains within a matrix of large amounts of transformed beta. This microstructure is of the type known to inhibit crack initiation.

EXAMPLE 2

Example 1 was repeated with a series of test specimens. The same procedures were followed, except that four different solution treatment temperatures were used for four different specimens: 1245° F., 1290° F., 1335° F., and 1380° F.; and the dehydrogenation time was 40 hours. Additionally, there was a post-dehydrogenation heat treatment of a solutionizing at 1650° F. for 2 hours in vacuum followed by cooling at about 100° F. per minute to 1350° F. followed by an an aging treatment at 930° F. for 24 hours in vacuum.

Prior to any treatment, the as-received material had a duplex primary alpha and transformed beta microstructure. After hydrogenation, solution treating, aging, and dehydrogenation, the material had a much finer alpha matrix with a greater concentration of transformed beta than in the as-received material. The amount of transformed beta increased with increasing solution temperature. After the further solution treat and aging treatment, the microstructure was coarser. The primary alpha grain size was refined as compared with the as-received grain size. The primary alpha grains contain beta particles. Some of the primary alpha grains appeared acicular.

Hydrogen content measurements were made of various samples. The hydrogenation treatment produced a hydrogen content of about 0.45 percent hydrogen. After the solution treatment, the hydrogen content was slightly lowered, about 0.35–0.43 percent. After dehydrogenation, the hydrogen content was reduced to about 0.009–0.013 percent, an acceptable range for this alloy.

These tests demonstrate that the hydrogen treatment is successful in producing a variety of microstructures that are of the type which inhibits crack initiation.

This invention has been described in connection with specific embodiments and examples. However, it will be readily recognized by those skilled in the art the various modifications and variations of which the present invention is capable without departing from its scope as represented by the appended claims.

What is claimed is:

1. A method of manufacturing a hollow article, comprising the steps of:

providing an article made of a titanium alloy, having an internal cavity, and having hydrogen present in the article at a near-surface region of the internal cavity but not in a body region remote from the near-surface region;

heat treating the article in a hydrogen-containing atmosphere; and removing the hydrogen from the article.

2. The method of claim 1, wherein the step of providing includes the steps of:

preparing at least two opposing parts of a hollow structure, each of the parts being made of a titanium alloy, diffusion bonding the opposing parts together, and thereafter introducing hydrogen from the interior of the internal cavity to the surface of the internal cavity.

3. The method of claim 2, wherein the step of preparing at least two opposing parts includes the step of preparing at least two opposing pieces of a hollow fan blade.

4. The method of claim 1, wherein the step of providing includes the steps of:

preparing at least two opposing parts of a hollow structure, each of the parts being made of a titanium alloy, introducing hydrogen from the interior of the internal cavity to the surface of the internal cavity, and thereafter diffusion bonding the opposing parts together.

5. The method of claim 4, wherein the step of preparing at least two opposing parts includes the step of preparing at least two opposing pieces of a hollow fan blade.

6. The method of claim 1, wherein the step of providing an article includes the step of heating the article in a hydrogen-containing atmosphere to a hydrogenation temperature for a period of time sufficient that hydrogen diffuses into the surface of the internal cavity.

7. A method of manufacturing a hollow article, comprising the steps of:

preparing at least two opposing parts of a hollow structure, the at least two parts being made of a titanium alloy and, when assembled, having an internal cavity therein;

processing the at least two opposing parts, the step of processing including the steps of diffusion bonding the opposing parts together to form a bonded article, and introducing hydrogen from the interior of the internal cavity to the surface of the internal cavity, the step of introducing hydrogen occurring before, simultaneously with, or after the step of diffusion bonding;

solution treating the bonded article at a solutionizing temperature in a hydrogen-containing solutionizing atmosphere;

aging the bonded article at an aging temperature less than the solutionizing temperature in a hydrogen-containing aging atmosphere; and removing the hydrogen from the bonded article so that the hydrogen content at the surface of the internal cavity is less than a preselected amount.

8. The method of claim 7, wherein the step of preparing at least two opposing parts includes the step of providing at least two opposing parts made of an alpha-beta titanium alloy.

9. The method of claim 7, wherein the step of preparing at least two opposing parts includes the step of preparing at least two opposing pieces of a hollow fan blade.

10. The method of claim 7, wherein the step of introducing hydrogen includes the step of heating the at least two opposing parts in a hydrogen-containing atmosphere to a hydrogenation temperature for a period of time sufficient that hydrogen diffuses into the surface of the internal cavity.

11. The method of claim 7, wherein the step of introducing hydrogen includes the step of heating the at least two opposing parts to a temperature of from about 1020° F. to about 1380° F. in an atmosphere containing hydrogen gas.

12. The method of claim 7, wherein the step of solution treating includes the step of heating the bonded article to a temperature of from about 1245° F. to about 1420° F. in an atmosphere containing hydrogen gas.

13. The method of claim 7, wherein the step of aging the bonded article includes the step of heating the bonded article to a temperature of from about 930° F. to about 1290° F. in an atmosphere containing hydrogen gas.

14. The method of claim 7, wherein the step of removing the hydrogen includes the step of heating the bonded article to a temperature of from about 1100° F. to about 1400° F. in an atmosphere that is substantially free of hydrogen.

15. The method of claim 7, including the additional step, after the step of removing the hydrogen, of post-dehydrogenation heat treating the bonded article.

16. A method of manufacturing a hollow fan blade, comprising the steps of:

preparing at least two opposing parts of a hollow fan blade made of an alpha-beta titanium alloy, the at least two parts when assembled having an internal cavity therein;

diffusion bonding the at least two opposing parts together to form a bonded article, heating the opposing parts to a temperature of from about 1020° F. to about 1380° F. in an atmosphere comprising a mixture of less than about 5 volume percent hydrogen in a carrier gas to introduce hydrogen from the interior of the internal cavity to the surface of the internal cavity, the step of introducing hydrogen occurring before, simultaneously with, or after the step of diffusion bonding;

heating the bonded article to a temperature of from about 1245° F. to about 1420° F. in an atmosphere comprising a mixture of less than about 5 volume percent hydrogen in a carrier gas to solution treat the bonded article;

heating the bonded article to a temperature of from about 930° F. to about 1290° F. in an atmosphere comprising a mixture of less than about 5 volume percent hydrogen in a carrier gas to age the bonded article; and heating the bonded article to a temperature of from about 1100° F. to about 1400° F. in an atmosphere that is substantially free of hydrogen to remove the hydrogen from the bonded article.

17. A method of manufacturing a hollow article, comprising the steps of:

providing a titanium-alloy article having a body, and an internal cavity including a surface of the internal cavity;

introducing hydrogen into at least a portion of a near-surface region of the internal cavity of the article but not into the body of the article at locations remote from the near-surface region;

heat treating the article so as to form a fatigue crack initiation-resistant microstructure at the portion of the near-surface region of the internal cavity and a fatigue crack propagation-resistant microstructure within the body of the article; and removing the hydrogen from the article.

18. The method of claim 17, wherein the step of providing an article comprises the step of providing an article made of an alpha-beta titanium alloy.

19. The method of claim 1, wherein the step of providing includes the step of providing an article made of an alpha-beta titanium alloy.

* * * * *